US006032006A

United States Patent [19]

Yanagida

[11] Patent Number: 6,032,006

[45] Date of Patent: Feb. 29, 2000

[54] IMAGE FORMING APPARATUS HAVING AN IMPROVED CLEANING MECHANISM AND METHOD THEREOF

[75] Inventor: Masato Yanagida, Tokyo, Japan

[73] Assignee: Ricoh Company, Ltd., Tokyo, Japan

[21] Appl. No.: 09/170,093

[22] Filed: Oct. 13, 1998

[30] Foreign Application Priority Data

Oct. 13, 1997 [JP] Japan ..... 9-279002

[51] Int. Cl.[7] ..... G03G 15/16; G03G 21/00

[52] U.S. Cl. ..... 399/101; 399/169; 430/125; 430/126

[58] Field of Search ..... 399/72, 98, 99, 399/101, 169, 314, 303, 343, 297; 430/125, 126

[56] References Cited

U.S. PATENT DOCUMENTS

| | | | |
|---|---|---|---|
| 4,373,800 | 2/1983 | Kamiyama et al. | 399/249 |
| 4,984,024 | 1/1991 | Ohkaji et al. | 399/299 |
| 5,107,285 | 4/1992 | Hamada et al. | 399/169 X |
| 5,386,274 | 1/1995 | Sanpe et al. | 399/101 |
| 5,627,629 | 5/1997 | Takahashi et al. | 399/231 |
| 5,640,230 | 6/1997 | Ono et al. | 430/125 X |
| 5,648,842 | 7/1997 | Sekine et al. | 430/125 X |
| 5,724,633 | 3/1998 | Amemiya | 399/303 X |
| 5,881,339 | 3/1999 | Yanagida et al. | 399/101 |

FOREIGN PATENT DOCUMENTS

| | | |
|---|---|---|
| 1-59376 | 3/1989 | Japan . |
| 9-80997 | 3/1997 | Japan . |

OTHER PUBLICATIONS

English Abstract of Japanese Patent No. 60–107686, dated Jun. 13, 1985.

*Primary Examiner*—Arthur T. Grimley
*Assistant Examiner*—Sophia S. Chen
*Attorney, Agent, or Firm*—Oblon, Spivak, McClelland, Maier & Neustadt, P.C.

[57] ABSTRACT

A novel image forming apparatus including a seamless belt-shaped moving member positioned adjacent to an image bearing member. Also included is a bias voltage applying roller positioned at a rear face side of the seamless belt-shaped moving member, and a cleaning blade for cleaning a surface of the seamless belt-shaped moving member. Further, a transfer-convey device configured to transfer a toner image on the image bearing member onto a transfer member is included. A toner-line forming device is configured to form a toner-line which is divided into a plurality of toner-line segments when developed, each of which is written to an individual non-image area between successive image areas on the image bearing member and transferred onto the seamless belt-shaped moving member.

22 Claims, 13 Drawing Sheets

IMAGE FORMING APPARATUS HAVING AN IMPROVED CLEANING MECHANISM AND METHOD THEREOF

BACKGROUND OF THE INVENTION

1. Field of the Invention

The present invention relates to an electrophotographic image forming apparatus, such as a copying machine, a facsimile machine, a printer and the like. The present invention particularly relates to an image forming apparatus provided with a transfer-convey device that transfers a toner image on an image bearing member to a transfer member and that holds and conveys the transfer member with a belt-shaped moving member (hereinafter referred to as a transfer belt).

2. Discussion of the Background

Typical steps of an electrophotographic image forming process used in many image forming apparatuses, such as copying machines, facsimile machines, and printers and the like are as follows:

charging a photoconductive element that serves as an image bearing member with a charging member;

causing the photoconductive element to be directly exposed to light reflected from an original document image using an exposing device, or optically writing an image on the photoconductive element according to an image signal by the use of an optical writing system that adopts a laser scanning system, an LED (Light Emitting Diode) writing system, or the like, so as to form an electrostatic latent image on the photoconductive element;

developing the latent image borne on the photoconductive element with toner particles contained in a developing device; and transferring the toner image onto a transfer member, such as a transfer sheet, a film such as a polyester film, or the like.

Thereafter, the transfer member holding the toner image thereon is conveyed to a fixing device. An image is obtained by means of the process as mentioned above.

In such an image forming apparatus, a transfer-convey device that includes a transfer belt has been widely used. The transfer belt has important roles in the above-mentioned transferring step of the image forming process, such as transferring the toner image which is borne on the photoconductive element onto the transfer member, subsequently separating the transfer member from the photoconductive element, and continuously conveying the transfer member to the fixing device.

The transfer belt of the transfer-convey device is generally a seamless belt-shaped moving member made of an elastic material, such as a material containing rubber and having a medium resistance. The transfer belt is movably positioned around a plurality of rollers such as a drive roller, a driven roller and the like, and is positioned adjacent to the photoconductive element.

When transferring an image from the photoconductive element, the transfer belt that conveys the transfer member contacts the photoconductive element. The transfer belt conveys the transfer member which is sandwiched at a nipping position between the photoconductive element and the transfer belt. The transfer belt transfers the toner image on the photoconductive element onto the transfer member by use of a high voltage power source unit that applies a high voltage to a bias voltage applying roller disposed at a rear side of the transfer member.

After the transfer member passes through the above-mentioned nipping position between the photoconductive element and the transfer belt and, as a result, receives the toner image, the transfer belt that continuously conveys the transfer member causes the transfer member to be separated from the surface of the rotating photoconductive element. Then, the transfer belt conveys the transfer member to the fixing device.

During the above-described transferring step of the transfer-convey device, the transfer belt may have an undesirable deposition of toner particles on the surface thereof, particularly in the areas which are not covered by the transfer member. Such toner particles may eventually adhere to the transfer member and cause a dirty toner spot on the transfer member. Accordingly, to keep the transfer member held on the transfer belt clean, a cleaning blade is provided in the image forming apparatus. The cleaning blade is configured to remove the toner particles remaining on the surface of the transfer belt.

When a number of relatively small images are reproduced, or when a number of blank copies are erroneously reproduced in a copying machine, for example, which is provided with the above-described transfer-convey device, the amount of toner which is transferred from the photoconductive element to the transfer belt is reduced. As a result, the transfer belt may have almost no toner particles remaining thereon. Also, the cleaning blade that contacts the transfer belt may have almost no toner remaining on its edge portion. Accordingly, a friction coefficient between the transfer belt and the cleaning blade increases, that is, a frictional resistance between these two elements increases. As a result, the cleaning blade with its edge portion in contact with the transfer belt may be caught on a belt surface and may peel off and become damaged.

If the cleaning blade causes the peel-off problem in the edge portion thereof due to the above-described reasons, several serious problems may subsequently be caused. For example, the transfer belt cannot be cleaned sufficiently, which results in a rear face fouling problem in that the transfer member becomes dirty with deposited toner particles. A toner scattering problem may also occur around the mechanism of the transfer-convey device.

To solve the above problems, an additional toner supply can be provided to the above-described image forming apparatus. The surface of the photoconductive element is basically composed of an image forming area and a non-image area; the image forming area is in contact with the transfer member and the non-image area is in contact with the transfer belt, during the transferring step. In the non-image area, a line image is formed so as to supply toner to the transfer belt. Such a line image is referred to as a toner-line. The toner-line is transferred onto the transfer belt during the transferring step, and the toner-line supplies toner particles to the edge portion of the cleaning blade contacting the transfer belt. Thereby, the increase of the friction between the transfer belt and the cleaning blade can be prevented. Thus, the cleaning blade can be prevented from incurring the above-mentioned peel-off problem.

The toner-line may preferably be written in a full length direction parallel to the axis of the photoconductive element. Such a toner-line may preferably be formed in a frequency of, for example, once per several copies.

This toner-line is formed to include a greater amount of toner in comparison with the amount of toner that remains on the transfer belt during the transferring step. Therefore, the cleaning blade may have an excessive amount of toner at a time, depending upon how the toner is supplied to the cleaning blade. For example, if the toner-line on the transfer belt is a straight line parallel to the cleaning blade, the cleaning blade in its full length receives the excessive amount of toner. In this case, the cleaning blade cannot sufficiently scrape off the toner.

Further, the cleaning blade may be constructed so as to be capable of sufficiently cleaning the toner even in the above-described case. For example, the cleaning blade is adjusted to have a relatively high contact pressure to the transfer belt in order to strongly scrape off the toner. However, the thus-adjusted cleaning blade may excessively scrape off the toner during usual cleaning operations. Accordingly, the cleaning blade may deteriorate at an earlier stage than usual as a side effect of such an adjustment.

There is known a method for improving a cleaning ability of the cleaning blade to clean a belt-shaped photoconductive element, in which the cleaning blade is set to a relatively low contact pressure against the belt-shaped photoconductive element (Japanese Patent Laid-pen publication No. 60-107686). This method makes the cleaning blade contact the belt-shaped photoconductive element in a direction at an incline to a direction perpendicular to a driving direction of the belt-shaped photoconductive element. If this method is adopted to the cleaning blade of the transfer belt, the toner can be sufficiently removed from the transfer belt under the usual cleaning condition, even though the aforementioned toner-line is formed.

However, if the cleaning blade is constructed with an angle in the manner as described above, a relatively large space is required for mounting the cleaning blade. Also, the cleaning blade is required to be placed in a flat, but not round, surface of the transfer belt. Namely, this cleaning blade may not be applicable to areas where the transfer belt is wrapped around the drive roller, the driven roller and the like. This is because in the above-mentioned case a pressure of the cleaning blade is not uniformly applied to the transfer belt. This causes an insufficient cleaning of the transfer belt. Accordingly, it is not preferable to set the cleaning blade with the angle in the manner as described above since a setting position for the transfer belt is restricted.

SUMMARY OF THE INVENTION

The present invention has been made in view of the above-discussed problems and an object of the invention is to address and resolve these and other problems.

To solve the aforementioned problems, the present invention is directed to a novel image forming apparatus which includes a seamless belt-shaped moving member positioned adjacent to an image bearing member, a bias voltage applying roller positioned at a rear face side of the seamless belt-shaped moving member, a cleaning blade for cleaning a surface of the seamless belt-shaped moving member, a transfer-convey device having a construction for transferring a toner image on the image bearing member onto a transfer member by bringing the seamless belt-shaped moving member that holds the transfer member into contact with the image bearing member that rotates, and by applying a relatively high voltage to the bias voltage applying roller for conveying the transfer member which bears the toner image on a surface thereof to a fixing device, and for cleaning toner remaining on a surface of the seamless belt-shaped moving member with the cleaning blade, and a toner-line forming device forming a toner-line which is divided into a plurality of toner-line segments when being developed, each of which is formed in an individual non-image area between successive image areas on the image bearing member, and for transferring the plurality of toner-line segments onto the seamless belt-shaped moving member.

A novel method according to the present invention includes the steps of forming a toner-line at a non-image area between successive image areas on an image bearing member, dividing the toner-line into a plurality of toner-lines, transferring the toner-lines onto a transfer-convey device, and cleaning the transfer-convey device with a cleaning blade.

Other objects, features and advantages of the present invention will become apparent from the following detailed description when read in conjunction with the accompanying drawings. Furthermore, while the drawings and descriptions illustrate specific structures, the present specification clearly explains the functions, concepts and attributes of the present invention in sufficient detail so as to make clear all equivalent structures and techniques for obtaining the desired result.

BRIEF DESCRIPTION OF THE DRAWINGS

A more complete appreciation of the present invention and many of the attendant advantages thereof will be readily obtained as the same becomes better understood by reference to following detailed description when considered in conjunction with the accompanying drawings, wherein.

DESCRIPTION OF THE PREFERRED EMBODIMENTS

Figure 1:
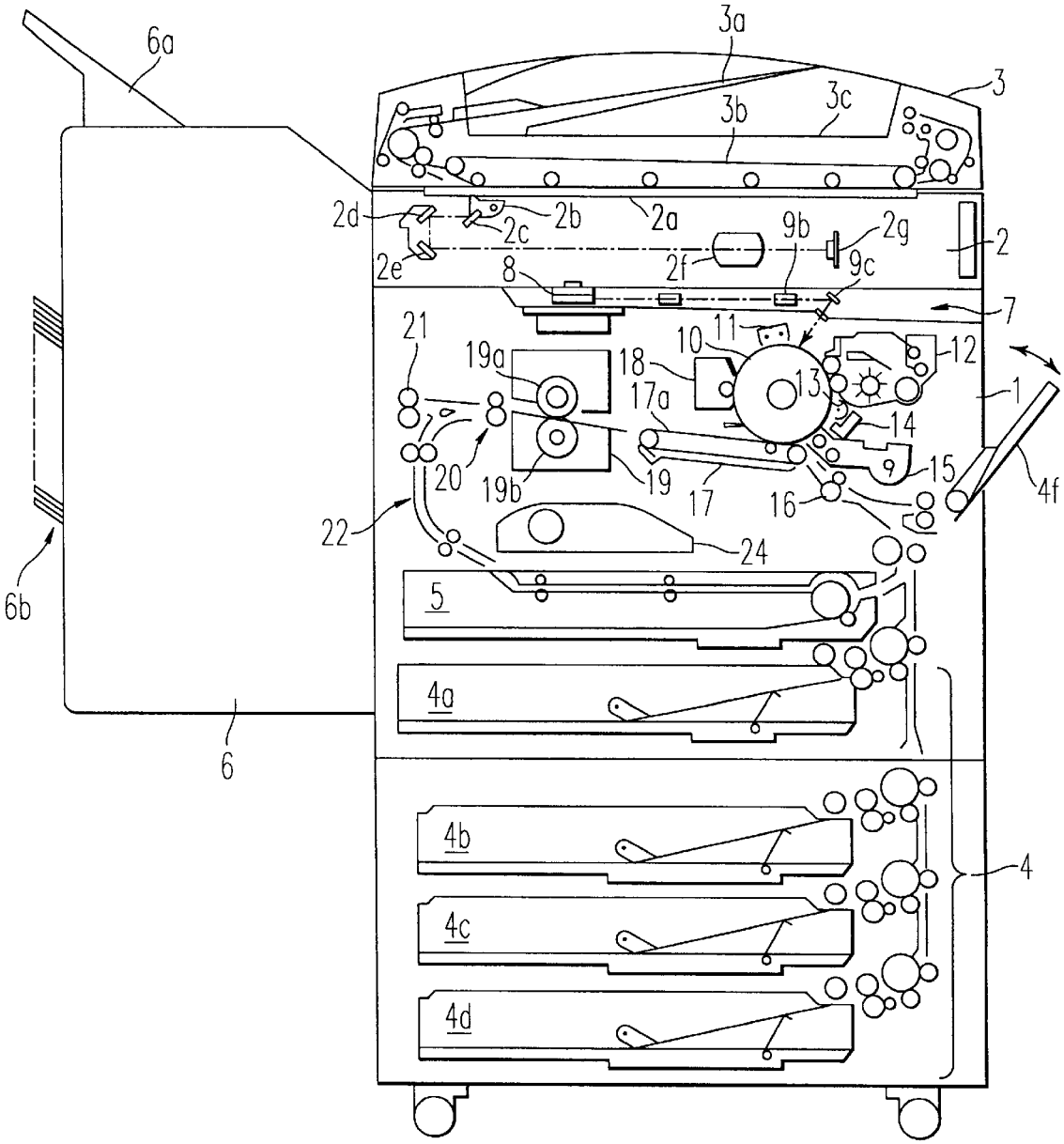
FIG. 1 illustrates an exemplary structure of an image forming apparatus having a transfer-convey device according to the present invention.

Referring now to the drawings, wherein like reference numerals designate identical or corresponding parts throughout the several views, an embodiment of the present invention is now described.

An image forming apparatus shown in FIG. 1 is an example of a digital copying machine that is used as a printer. This image forming apparatus includes an image forming section (e.g., printer) 1 that performs an image forming operation according to an electrophotographic process, a document reading section (e.g., scanner) 2 that optically reads original document images, an ADF (automatic document feeder) 3 that automatically feeds original documents, a sheet feeding section 4 that includes a plurality of sheet feeding trays 4*a* through 4*d* and that feeds transfer sheets of each type, a tray 5 that temporarily stores and re-feeds a transfer sheet which has been copied on one side in a duplex copying mode, and a discharging section (e.g., a sorter) 6 for sorting copied sheets or printed sheets, etc.

The ADF 3 is mounted on a contact glass 2*a* of the document reading section 2 and swings to an open and closed position by having a fulcrum around a rear side thereof. The ADF 3 is operable when it is in the closed position. The ADF feeds the original documents, which are placed on a document table 3*a*, via a plurality of document feed rollers with a conveying belt 3*b* onto the contact glass 2*a*. The ADF discharges the original documents to a document discharging section 3*c* after an optical reading operation of the document image by the scanner 2. Further, the original document can be set on the contact glass 2*a* by a manual sheet feeding operation when the ADF is opened.

The scanner 2 includes a light source 2*b* that irradiates light to the original document on the contact glass 2*a*, a reading section 2*g* that is composed of an image pickup sensor for reading the document image, a mirror group 2*c*, 2*d* and 2*e* that reflects a document image towards the reading section 2*g*, and an optical system composed of a focus lens 2*f* The light source 2*b* and the mirror group 2*c*, 2*d* and 2*e* scan the original surface and move in a predetermined direction.

The reading section 2*g* converts the document image into an image signal by sequentially reading the document image, and transmits the signal to an image processing section (not shown). In addition, since the copying machine shown in FIG. 1 includes a developing device for a black image and mono-color images, such as a red image and a blue image other than a black image, a color CCD (Charge-Coupled Device) capable of reading the color image using a color separation is used as an image pickup sensor. Image data is converted into the image signal corresponding to a respective color at the image processing section.

The printer 1 includes a drum-shaped photoconductive element 10 as an image bearing member, a first charging device 11 positioned around the photoconductive element 10, a first optical writing device 7, a first developing device 12, a second charging device 13, a second optical writing device 14, a second developing device 15, a registration roller 16, a transfer-convey device 17, a cleaning device 18, etc., and in addition, a fixing device 19 is provided downstream from the transfer sheet conveying direction of the transfer-convey device 17.

The first charging device 11, the first optical writing device 7, and the first developing device 12 are capable of forming a black image. The first optical writing device 7 includes a laser diode 9*a*, a light deflection device 8, such as a rotating polygon mirror or the like, a scan focusing device 9*b*, such as an fθ lens, and a mirror 9*c*. The laser diode 9*a* generates a laser light according to a black image signal from the image processing section. The first optical writing device 7 optically writes a black latent image on the photoconductive element 10 that is charged with the first charging device 11. The black latent image is then developed with black toner in the first developing device 12.

The second charging device 13, the second optical writing device 14, and the second developing device 15 are capable of forming the mono-color image of red, blue, and the like. The second charging device 13 charges the photoconductive element 10 after forming the black image. The second optical writing device 14 includes an LED array and a lens array. The LED array emits light according to a color image signal of red, blue, and the like, from the image processing section.

The second optical writing device 14 optically writes a latent image of color image, such as red, or blue, and the like on the photoconductive element 10, and then the latent image of the color image is developed with a color toner, such as red, blue, and the like at the second developing device 15. A toner image including the black toner image or the mono-color toner image formed on the photoconductive element 10 is transferred onto the transfer sheet. The transfer sheet is fed from either one of the plurality of sheet feeding trays 4*a* through 4*d* of the sheet feeding section 4 or the manual sheet feeding table 4*f*, and is conveyed to a nip portion between the transfer belt 17*a* of the transfer-convey device 17 and the photoconductive element 10 via the registration roller 16.

Further, the transfer sheet, after the image is transferred, is separated from the photoconductive element 10, and conveyed to the fixing device 19 by the transfer belt 17*a*. The toner image is fixed on the transfer sheet with a heating roller 19*a* and a pressure roller 19*b* of the fixing device 19. The transfer sheet, after the fixing operation, is discharged to a discharging tray 6*a* or to a multistage sheet discharging tray 6*b* via sheet discharging rollers 20 and 21 when one-side copying is performed. The transfer sheet, after the fixing operation, is discharged to a duplex tray 5 through a duplex conveying path 22 when duplex copying is performed.

The residual toner on the photoconductive element 10 after the toner image is transferred is removed with the cleaning device 18. The photoconductive element 10 is then discharged with a discharging device (not shown). Further, the residual toner accumulated in the cleaning device 18 is conveyed to an abrogating toner tank 24 with a conveying mechanism (not shown).

An example of the image forming apparatus provided with the transfer-convey device relevant to the present invention is now briefly described. The image forming apparatus which the present invention is applied to is not limited to the construction shown in FIG. 1. An analog type copy machine in which the photoconductive element is directly exposed with an image of an original document, or a construction that includes a printer is applicable for the image forming apparatus if the transfer-convey device is provided therein.

Further, the present invention is applicable to both a mono-color image forming apparatus including only one optical writing device and one developing device, and a color image forming apparatus including a plurality of developing devices with color toner, such as black, cyan, magenta, yellow, etc.

A construction and operation of the transfer-convey device relevant to the present invention is described hereinbelow in detail.

Figure 2:
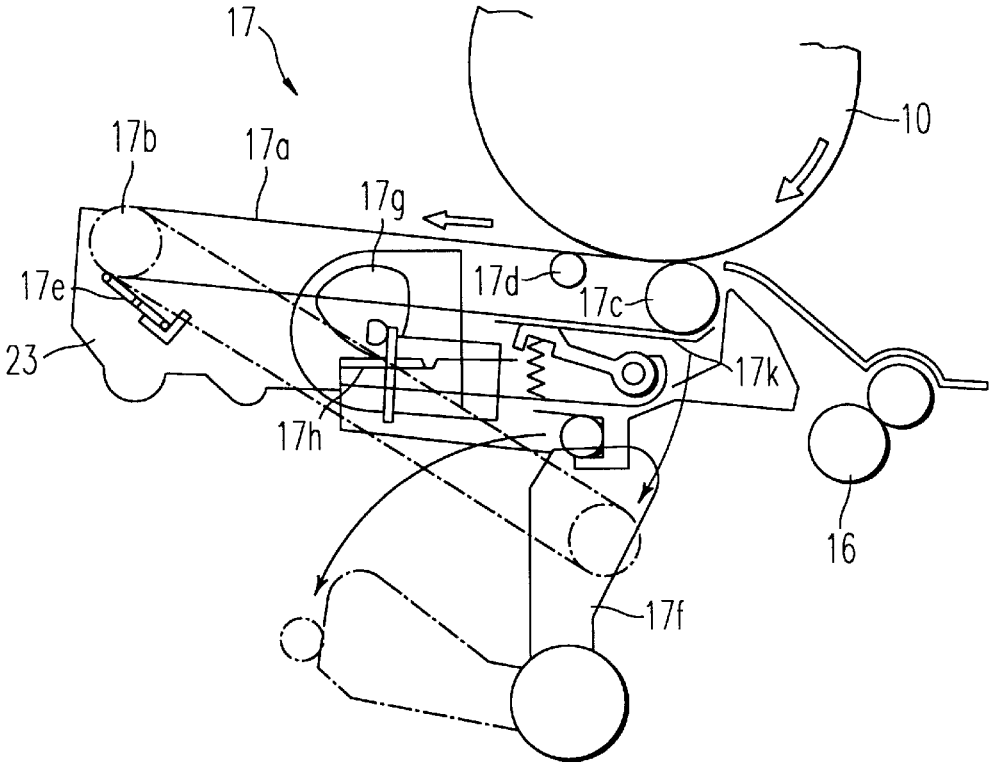
FIG. 2 illustrates a schematic structure of the transfer-convey device.

In FIG. 2, the transfer-convey device 17 includes an endless-belt shaped transfer belt 17*a* having a medium resistivity which is positioned adjacent to the photoconductive element 10, a drive roller 17*b* and a driven roller 17*c* which support the transfer belt 17*a*, a bias roller 17*d* for applying a transfer bias voltage to a rear side of the transfer belt 17*a*, and a cleaning blade 17*e* for cleaning a surface of the transfer belt 17*a*. The transfer-convey device 17 also includes a contact/separate mechanism including an electromagnetic spring clutch 17*g* with a cam, and a contact/separate lever 17*h* for contacting and separating the transfer belt 17*a* to the photoconductive element 10, and a releasing mechanism (a release lever 17*f*) for releasing the transfer-convey device 17.

A contact pressure of the transfer-convey device 17 to the photoconductive element 10 is released when the release lever 17*f* is turned counterclockwise (indicated by an arrow in FIG. 2). The transfer-convey device then rotates clockwise around the drive roller 17*b* which results in releasing the contact pressure. This mechanism has advantages such that a jammed sheet can be removed with ease, and the transfer-convey device, a photoconductive drum, and the like are easy to attach/detach for maintenance.

Figure 3A:
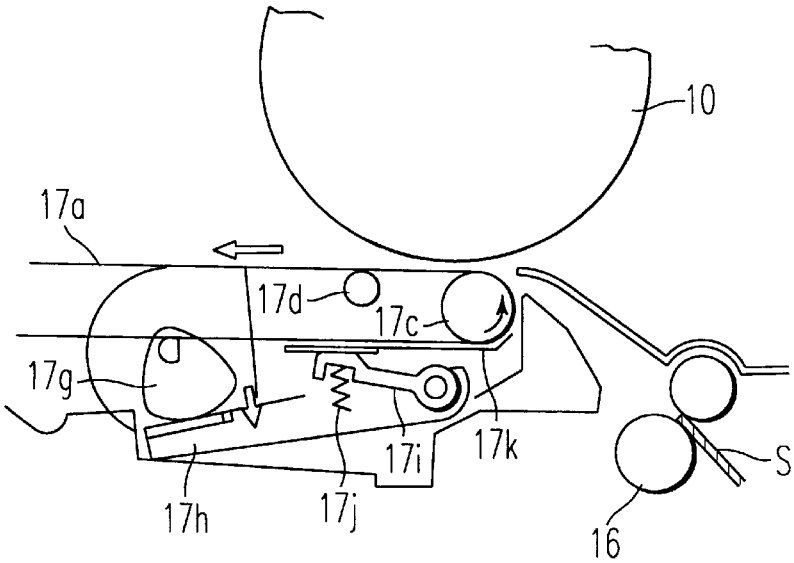
FIGS. 3A and 3B are explanatory views of a contact-separate mechanism of a transfer belt of the transfer-convey device.

The contact/separate mechanism for the transfer belt 17*a* includes the electromagnetic spring clutch 17*g* with a cam, the contact/separate lever 17*h*, a contact/separate arm 17*i*, and a spring 17*j* as shown in FIG. 3A. The contact/separate arm 17*i* is fixed at a shaft of the contact/separate lever 17*h*, and the spring 17*j* is inserted between a bottom of a tip portion of the contact/separate arm 17*i* and a basement of the transfer-convey device.

Further, a top of a tip portion of the contact/separate arm 17*i* supports the transfer belt 17*a* by contacting the supporting member 17*k* thereof FIG. 3A shows a state that the contact/separate lever 17*h* is pushed down by the cam of the electromagnetic spring clutch 17*g* against a pressing force of the spring 17*j*. The transfer belt 17*a* is therefore separated from the photoconductive element 10. This state is continued for the time other than that when performing an image forming operation. When the image forming operation is started, a transfer sheet S conveyed-to/stopped-at the registration roller 16 is again started to move by the registration roller 16, and is adjusted with a timing of a leading edge of the image on the photoconductive element 10.

Figure 3B:
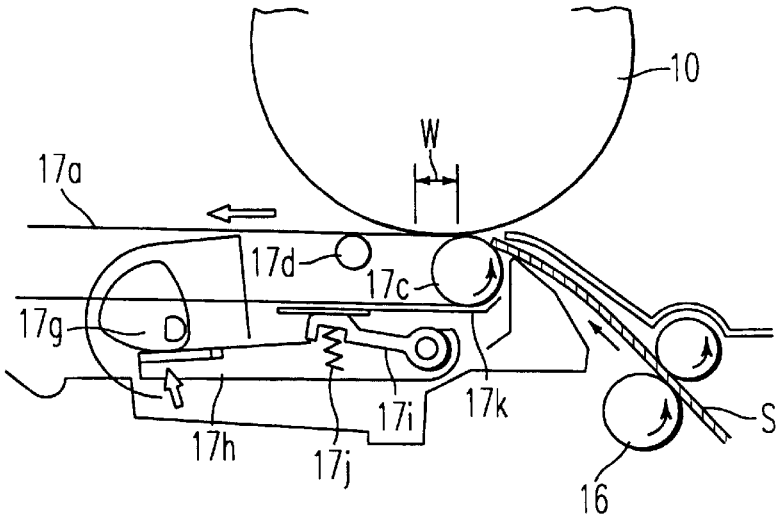

When a leading edge of the sheet S reaches the position where the photoconductive element 10 and the transfer belt 17*a* contact, the electromagnetic spring clutch 17*g* is turned on and the cam rotates in half of a rotation. Then, the contact/separate lever 17*h* is lifted up as shown in FIG. 3B, and the contact/separate arm 17*i* is also lifted up resulting in pressing upwards the supporting member 17*k* by the pressing force of the spring 17*j*. Thereby, the transfer belt 17*a* contacts the photoconductive element 10 and a nip portion W is formed. The toner image is transferred onto the transfer sheet S at the nip portion W.

Thereafter, when a transfer operation is over, the electromagnetic spring clutch 17*g* is turned off, and the cam returns to the state indicated by FIG. 3A. Since the contact/separate lever 17*h* is pushed downwards and the contact/separate arm 17*i* moves down, the transfer belt 17*a* is separated from the photoconductive element 10.

This contact/separate mechanism of the transfer belt 17*a* prevents a material, such as oil or a like component contained on the transfer belt 17*a* from adhering to the photoconductive element 10. This contact/separate mechanism avoids a problem, such as a transfer of the toner image onto the transfer belt 17*a* when a toner density of a pattern on the photoconductive element 10 is detected by a P-sensor (a sensor for detecting/controlling the toner density in the developer that detects the toner density of the pattern formed on a photoconductive element instead of directly detecting a toner density in the developer).

Figure 4A:
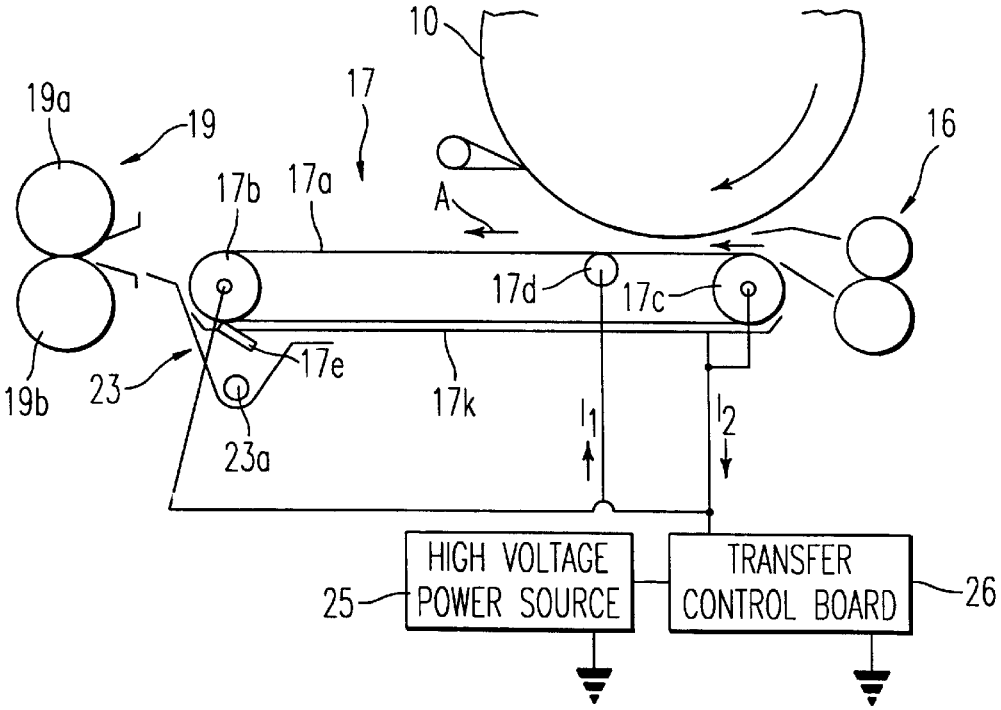
FIGS. 4A and 4B are explanatory views of a construction and an operation of the transfer-convey device including an electric system.
Figure 4B:
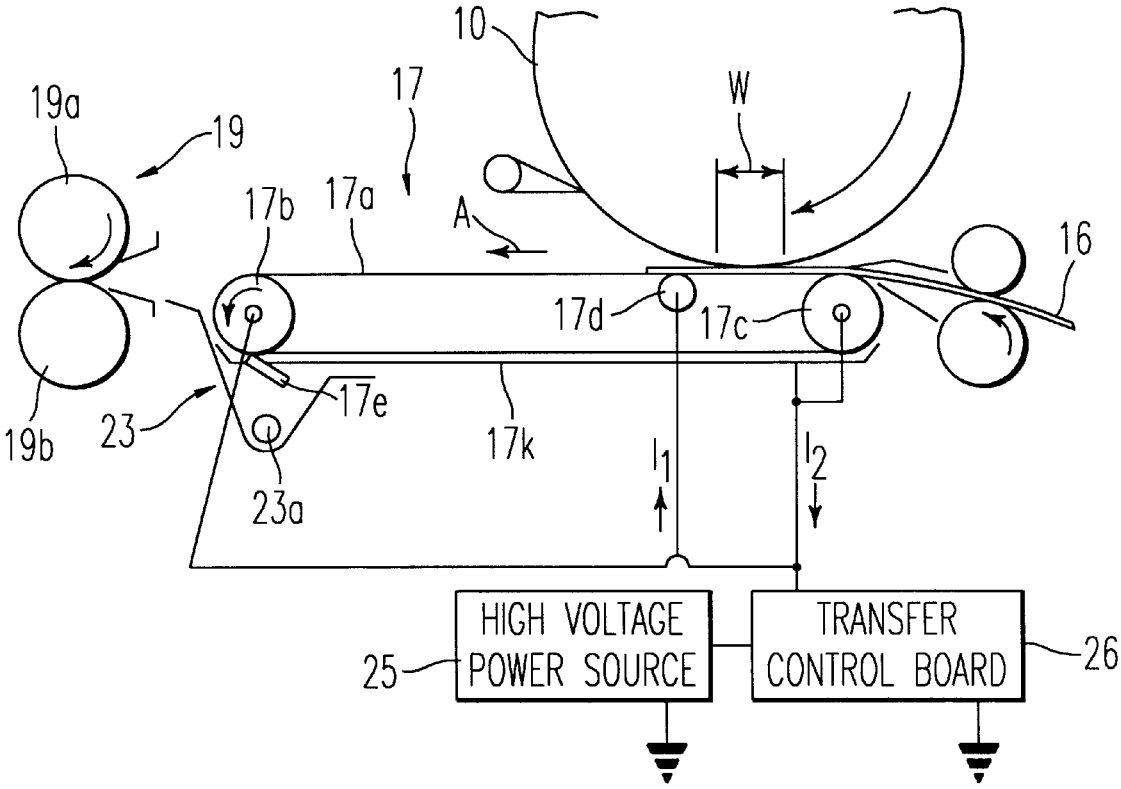
Figure 5:
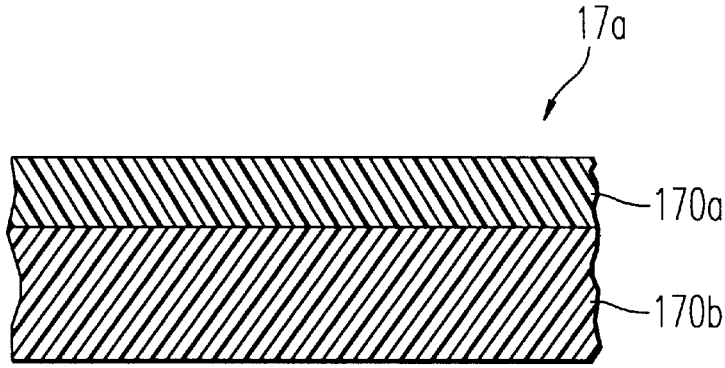
FIG. 5 is a partial cross-sectional view of the transfer belt.

Next, a basic construction/operation of the transfer-convey device is described referring to FIGS. 4A through 6. FIG. 4A shows a state of the transfer belt 17*a* separated from the photoconductive element 10, and FIG. 4B shows another state of the transfer belt 17*a* contacting the photoconductive element 10. As shown in FIG. 5, the transfer belt 17*a* has a two-layer structure. Resistance of each part is based on JIS (Japanese Industrial Standard) K6911 and is set as follows:

A surface layer 170*a* of the transfer belt 17*a* has a surface resistivity of $1\times10^{9}\Omega$ through $1\times10^{12}\Omega$ at the belt surface, an inner layer 170*b* of the transfer belt 17*a* has a surface resistivity of $1\times10^{7}\Omega$ through $1\times10^{9}\Omega$ at the belt surface, and the transfer belt 17*a* has a volume resistivity of $5\times10^{8}\Omega\cdot$cm through $5\times10^{10}\Omega\cdot$cm, when measured while a DC voltage of 100 V is applied.

In FIGS. 4A and 4B, the bias roller 17*d* for applying a transfer bias voltage to the transfer belt 17*a* is provided at a position which is downstream of the driven roller 17*c* in a moving direction A of the transfer belt 17*a* so as to contact the rear side of the transfer belt 17*a*. The bias roller 17*d* forms a contact electric pole to the transfer belt 17*a* for applying a charge of a polarity which is reverse to that of the charged toner on the photoconductive element 10. The bias roller 17*d* is connected to a high voltage power source 25.

The drive roller 17*b* and the driven roller 17*c* detect a current that flows through the transfer belt 17*a* as a feedback current. The supplied current from the bias roller 17*d* is controlled by the detected current. Accordingly, a transfer control plate 26 for setting a supply-current to the bias roller 17*d* corresponding to the detected current is connected to each of the rollers 17*b* and 17*c*.

In the thus-constructed transfer-convey device 17, the supporting member 17*k* is brought to a state causing the transfer belt 17*a* to contact the photoconductive element 10 by the contact/separate mechanism shown in FIG. 3 corresponding to the start time of the transfer sheet S from the registration roller 16. The supporting member 17*k* moves from the position shown in FIG. 4A, where the transfer belt 17*a* is separated from the photoconductive element 10, to another position shown in FIG. 4B where the transfer belt 17*a* contacts the photoconductive element 10. Thereby, the nip portion W having a width (about 12 mm, for example) is formed so that the transfer sheet S can be conveyed therethrough contacting the photoconductive element 10 at a position where the transfer belt 17*a* faces the photoconductive element 10.

Figure 6:
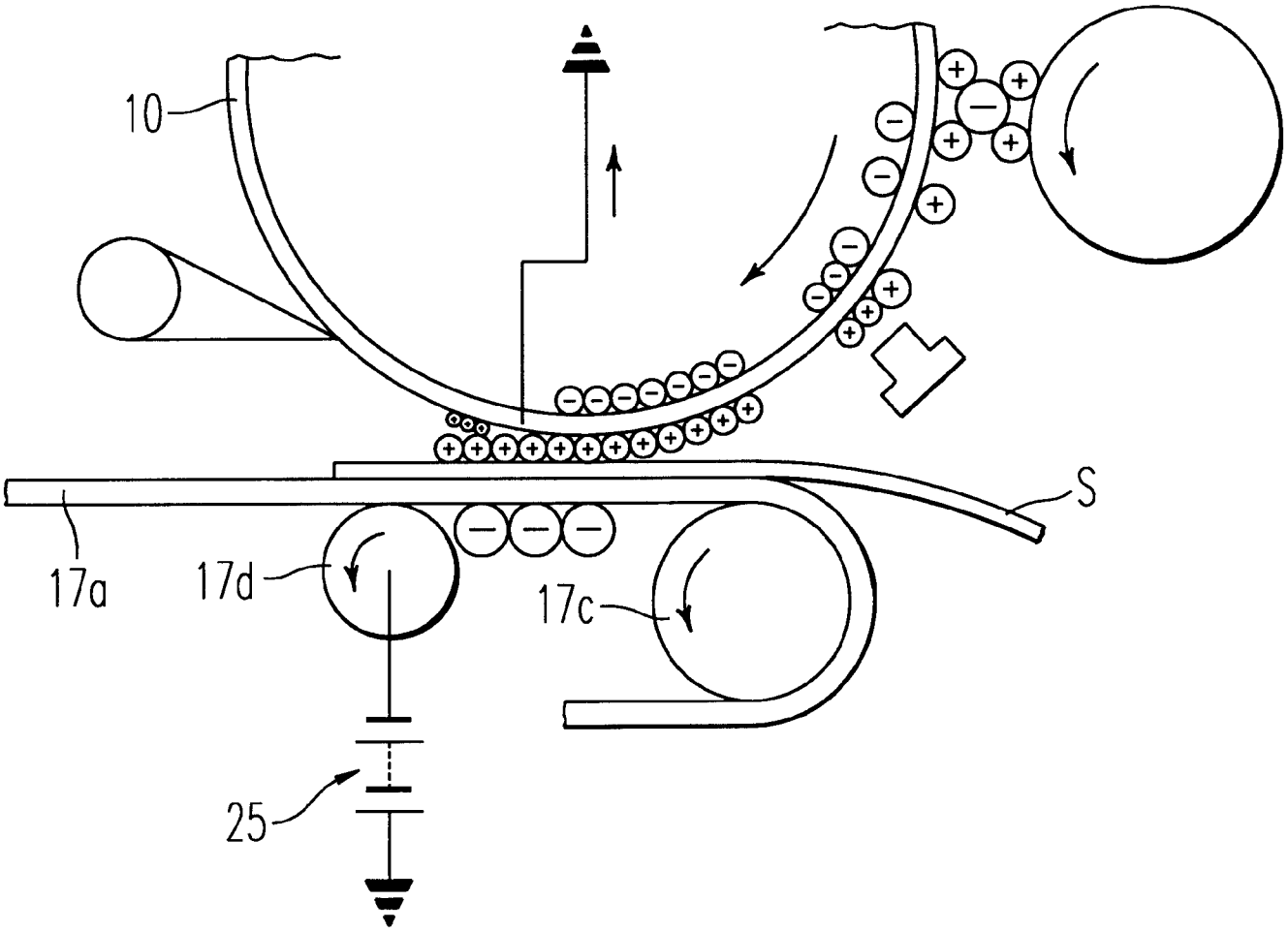
FIG. 6 is an explanatory view of a transfer process of the transfer-convey device of FIGS. 4A and 4B.

On the other hand, the photoconductive element 10 is charged at a voltage of, for example, −800 V. The charged portion of the photoconductive element 10, in which positive charged toner electrostatically adheres on the surface thereof, moves to the nip portion W as shown in FIG. 6. At the nip portion W shown in FIG. 4B, the toner on the photoconductive element 10 is transferred onto the transfer sheet S by the transfer bias voltage of the bias roller 17*d* positioned at a rear side of the transfer belt 17*a*, as shown in FIG. 6

This transfer bias voltage is applied by the high voltage power source 25 in a range of −6.5 kV through −1.5 kV. This transfer bias voltage is variably set in accordance with a constant current control as follows. When $I_1$ represents a current value output from the high voltage power source 25 and $I_2$ represents a detected current value of a feedback current which flows through the transfer belt 17*a* to a grounded side from each of the rollers 17*b* and 17*c*, as shown in FIGS. 4A and 4B, $I_1$ is controlled so that the following relation holds: ($I_{out}$ is constant)

$$I_1-I_2=I_{out}$$

This operation is to eliminate a variation of transfer efficiency by forming a surface potential $V_p$ on the transfer sheet S, regardless of a variation of an environmental condition, such as a temperature, humidity, etc., regardless of unevenness which occurs because of a manufacture quality of the transfer belt 17*a*. More specifically, assuming that $I_{out}$ is a current that flows to the photoconductive element 10 side through the transfer belt 17*a* and the transfer sheet S, a separation capability and a transfer capability of the transfer sheet S is prevented from being affected by a variation of easiness of the current to flow through the transfer belt 17*a* that depends on a decrease or increase of a surface resistivity $R_p$ on the transfer sheet S.

Further, in this embodiment, when $I_{out}$ is set as:

$I_{out}=-35\ \mu A\pm 5\ \mu A$, at a conveying speed of 330 mm/sec and an effectual bias applying roller length of 310 mm, a good transfer capability is obtained.

Furthermore, when the toner image is transferred from the photoconductive element 10, the transfer sheet S is simultaneously charged. Therefore, a separation of the transfer sheet from the photoconductive element 10 can be performed by electrostatically attracting the transfer sheet S onto the transfer belt 17*a* according to a relation between a true charge of the transfer belt 17*a* and a polarization charge that occurs at the transfer sheet S side. In addition, the separation capability of the transfer sheet S is advanced by the effect of a peel-off action of the transfer sheet S according to its own stiffness and the curvature of the photoconductive element 10 (hereinafter referred to as "curvature separation").

However, the separation of the transfer sheet S utilizing the electrostatic attraction is not always performed since the separation capability depends on an environmental condition, such as humidity, for example. The separation of the transfer sheet is not sufficiently performed under high humidity, since the current tends to flow through the transfer sheet S under a condition of high humidity. Accordingly, the resistance value of the surface layer 170*a* of the transfer belt 17*a* shown in FIG. 5 is set slightly high to delay a transfer of the true charge to the transfer sheet S at the nip portion W.

Further, the bias roller 17*d* is positioned downstream of the nip portion W in a conveying direction of the transfer sheet S. Thereby, the transfer of the true charge from the transfer belt 17*a* to the transfer sheet S is delayed and an electrostatic attraction between the transfer sheet S and the photoconductive element 10 is avoided.

The words "delay a transfer of the true charge" signifies that the transfer sheet S is not charged at an upstream position of the nip portion W of the photoconductive element 10 where the transfer sheet S reaches. Thus, the transfer sheet S is prevented from wrapping around the photoconductive element 10, and a failure of the separation of the transfer sheet S from the photoconductive element 10 is also prevented.

Further, a material having a less resistance variation due to a variation of the environment is also preferable to be used for the transfer belt 17*a*. A carbon and a zinc oxide are appropriately added into the material of the transfer belt 17*a* as a conductive material that controls a resistance value. When a rubber belt is used as an elastic belt, a chloroprene rubber, an EDPM (ethylene-propylene-diene-methylene) rubber, a silicone rubber, an epiclorohydrin rubber, and a like material having a less hygroscopic property and stable resistance value are preferable.

Furthermore, the current value $I_{out}$ that flows to the side of the photoconductive element 10 is not fixed to a definite value. This $I_{out}$ can be decreased when the conveying speed of the transfer belt is relatively fast, while being increased when the conveying speed of the transfer belt is relatively slow.

On the other hand, the transfer sheet S that is passed through the nip portion W is conveyed along with the movement of the transfer belt 17*a* being electrostatically attracted thereof and separated with the curvature separation at a position of the drive roller 17*b*. A diameter of the drive roller 17*b* is set to 18 mm or less so that the curvature separation is well performed. As a result of an experiment, it was determined that a high quality paper sheet of 45 Kg (this represents the thickness of the sheet) and a rigidity of 21 $cm^3$/100 in a widthwise direction of the sheet can be separated.

The transfer sheet S separated from the transfer belt 17*a* at a position of the drive roller 17*b* is conveyed to a nip portion between the heating roller 19*a* and the pressure roller 19*b* included in the fixing device 19 and is guided with a guide plate. The toner on the transfer sheet S is heated/melted and pressed thereon at the fixing device 19 and then fixed on the transfer sheet S.

The transfer belt 17*a* completes the image transfer onto the transfer sheet S and the transfer sheet S is seperated from the photoconductive element 10 by the contact/separate mechanism in which the supporting member 17*k* moves down. Then, a cleaning unit 23 cleans the surface of the transfer belt 17*a*. The cleaning unit 23 includes a cleaning blade 17*e*.

The cleaning blade 17*e* rubs the transfer belt 17*a* and thereby the toner transferred from the surface of the photoconductive element 10, the remaining toner scattered around the periphery of the transfer belt 17*a* that was not transferred onto the transfer sheet S, and paper powder are scraped off from the transfer belt 17*a*.

The surface of the transfer belt 17*a* which is rubbed by the cleaning blade 17*e* is coated with a material having a low friction coefficient, such as fluorine-containing resins, for example, polyvinylidene fluoride, tetrafluoroethylene, or the like for preventing an increase of a required driving force (load) due to an increase of the rubbing resistance, and for preventing a phenomenon, such as the peel-off of the cleaning blade 17*e* or the like.

In addition, the toner or the paper powder that is scraped off from the surface of the transfer belt 17*a* is conveyed to an abrogation toner tank 24 of the main body of the image forming apparatus shown in FIG. 1 by an accumulation screw 23*a*.

Thus, a basic construction and operation of the transfer-convey device is described. In the image forming apparatus provided with such a transfer-convey device 17, the surface of the transfer belt 17*a* includes a state having no remaining toner, when many copies having a small image area are produced, or when many white copies are erroneously produced. The toner at an edge portion of the cleaning blade 17*e* that contacts the transfer belt 17*a* also becomes empty. Accordingly, a friction coefficient between the transfer belt 17*a* and the cleaning blade 17*e* increases, which results in increasing a frictional resistance. Therefore, the edge portion of the cleaning blade 17*e* is caught on the surface of the transfer belt 17*a*, and may peel off as a result.

If the edge portion of the cleaning blade 17*e* peels off, a rear face fouling of the transfer member due to insufficient cleaning of the transfer belt 17*a* may occur, and toner scattering may also occur. The transfer belt 17*a* may also be damaged.

To resolve the above problems, a line for supplying toner (hereinafter referred to as a toner-line) to the contact portion of the transfer belt 17*a* and the cleaning blade 17*e* is formed for preventing the peel-off of the cleaning blade 17*e* in the present invention. This toner-line is formed at a position between areas on the photoconductive element 10 where the transfer sheets S conveyed in a series manner contact the photoconductive element 10 (hereinafter referred to as a non-image area between successive image areas). A device for transferring this line onto the transfer belt 17*a* is provided in the present invention.

Namely, a toner-line is formed at the non-image area between successive image areas on the photoconductive element 10, and the toner-line is transferred onto the non-image area between successive image areas of the transfer belt 17*a*. The toner is supplied to the edge portion of the cleaning blade 17*e*. Thereby, the increase of the friction coefficient between the transfer belt 17*a* and the cleaning blade 17*e* is prevented, and the cleaning blade does not peel off and become damaged.

As the toner-line mentioned above, for example, a line of width about 2 mm in a full length of a widthwise direction of the image is written at the non-image area between successive image areas of the photoconductive element 10 and is transferred onto the non-image area between successive image areas of the transfer belt 17*a*. However, this toner-line includes more toner in comparison with remaining toner that adheres on the transfer belt 17*a* after the toner is transferred onto the transfer sheet S in a usual manner.

Accordingly, if the toner-line on the transfer belt 17*a* is a straight line placed in parallel with the cleaning blade 17*e*, the toner is supplied to the cleaning blade 17*e* at a full length in the widthwise direction at the same time. Therefore, since the toner is excessively supplied to the edge portion of the cleaning blade 17*e*, the toner cannot be removed with the cleaning blade 17*e*.

Otherwise, if the cleaning blade 17*e* is constructed under a condition such that, for example, a contact pressure of the cleaning blade 17*e* to the transfer belt is set relatively high to enable the toner to be removed, the cleaning capability of the cleaning blade 17*e* exceeds an amount of actual remaining toner to be removed during a usual cleaning operation. Thus, the deterioration of the cleaning blade 17*e* as a side effect occurs at an early stage.

Figure 7:
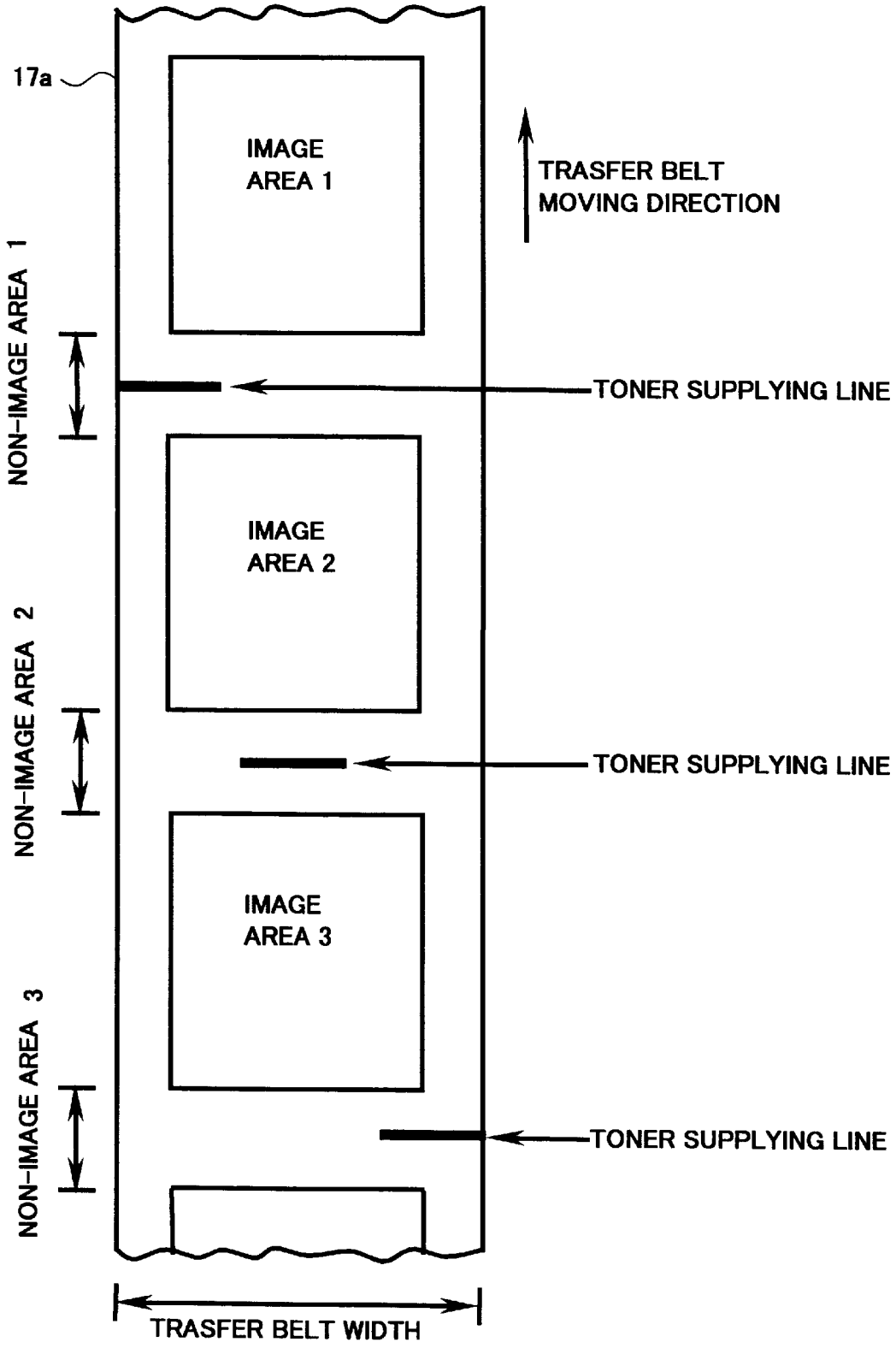
FIG. 7 is an illustration explaining how exemplary lines for supplying toner are formed in non-image areas of a photoconductive element.

Therefore, in the present invention, the toner-line is written at the non-image area between successive image areas on the transfer belt 17*a* by dividing a length of the toner-line. For example, FIG. 7 illustrates an embodiment of the present invention. Three toner-lines in which one straight toner-line is divided and written at each of the non-image area between successive image areas on the transfer belt 17*a* when developed on a plane surface. The divided toner-lines are perpendicular to the belt moving direction and are positioned at the non-image area between successive image areas.

Namely, in the present invention, the toner-line is not written in a full length thereof on the transfer belt 17*a* at the same time. Rather, the toner-line is divided and written on the transfer belt 17*a* onto each non-image area between successive image areas, as shown in FIG. 7. Thereby, a large amount of toner is not input on the cleaning blade 17*e* at the same time, and the cleaning performance of the cleaning blade 17*e* is significantly improved.

In addition, a contact pressure of the cleaning blade can be decreased, and the toner on the transfer belt 17*a* can be removed, even though a relatively low contact pressure used during the usual cleaning operation is applied. Thereby, a deterioration of the cleaning blade 17*e* at the early stage can be avoided. Further, writing the divided toner-line onto each non-image area between successive image areas can decrease the amount of input toner per one non-image area between successive image areas.

Figure 8:
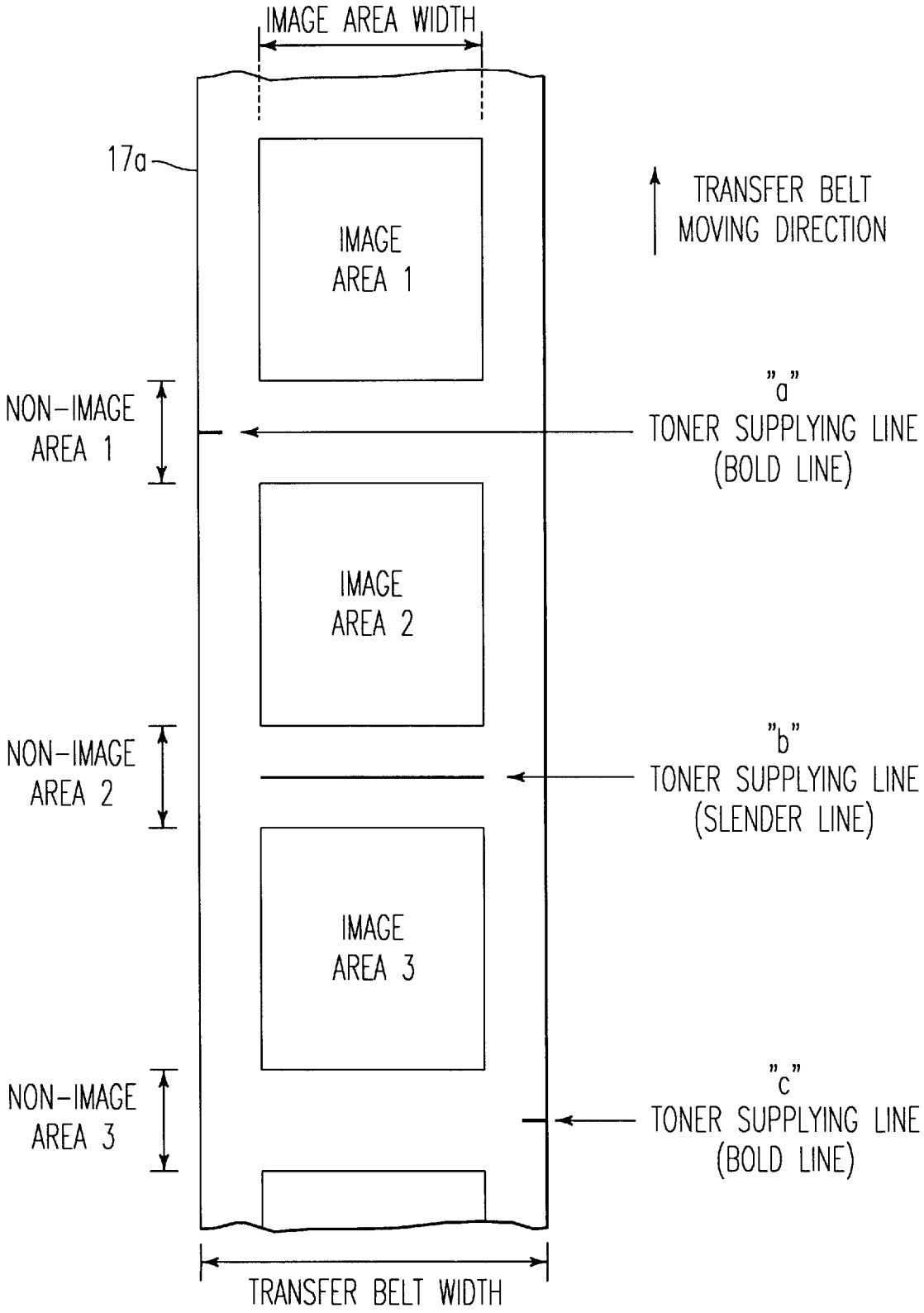
FIG. 8 is an illustration explaining how different exemplary lines for supplying toner are formed in non-image areas of a photoconductive element.

Next, FIG. 8 illustrates another example of the toner-line, which is divided and written onto each of the non-image area between successive image areas on the transfer belt 17*a*. As shown, a toner-line is divided into three toner-lines each having a different thickness. Further, the three toner-lines are written at the non-image area between successive image areas.

In this example, the lines a and c written at side portions at an outside of the image area (i.e., on the sides of the transfer belt 17*a*) are thick lines, and the line b written at a portion inside of the image area, which is a center part of the transfer belt 17*a*, is a thin line. As shown in FIG. 8, the toner-line is divided into a plurality of lines positioned at each non-image area between successive image areas, and the thickness of the lines are different from each other. Thereby, a great amount of toner is not input on the cleaning blade 17*e* at the same time, and the cleaning performance of the cleaning blade 17*e* is significantly improved.

In addition, a contact pressure of the cleaning blade can be decreased, and the toner on the transfer belt 17*a* can be removed even when a relatively low contact pressure during the usual cleaning operation is applied. The deterioration of the cleaning blade 17*e* at the early stage can also be avoided. Further, the amount of input toner per one non-image area between successive image areas can be decreased by dividing and writing the toner-line onto each non-image area between successive image areas, and by writing the same in different thicknesses. In addition, the amount of toner supplied per each non-image area between successive image areas can be controlled.

Figure 9:
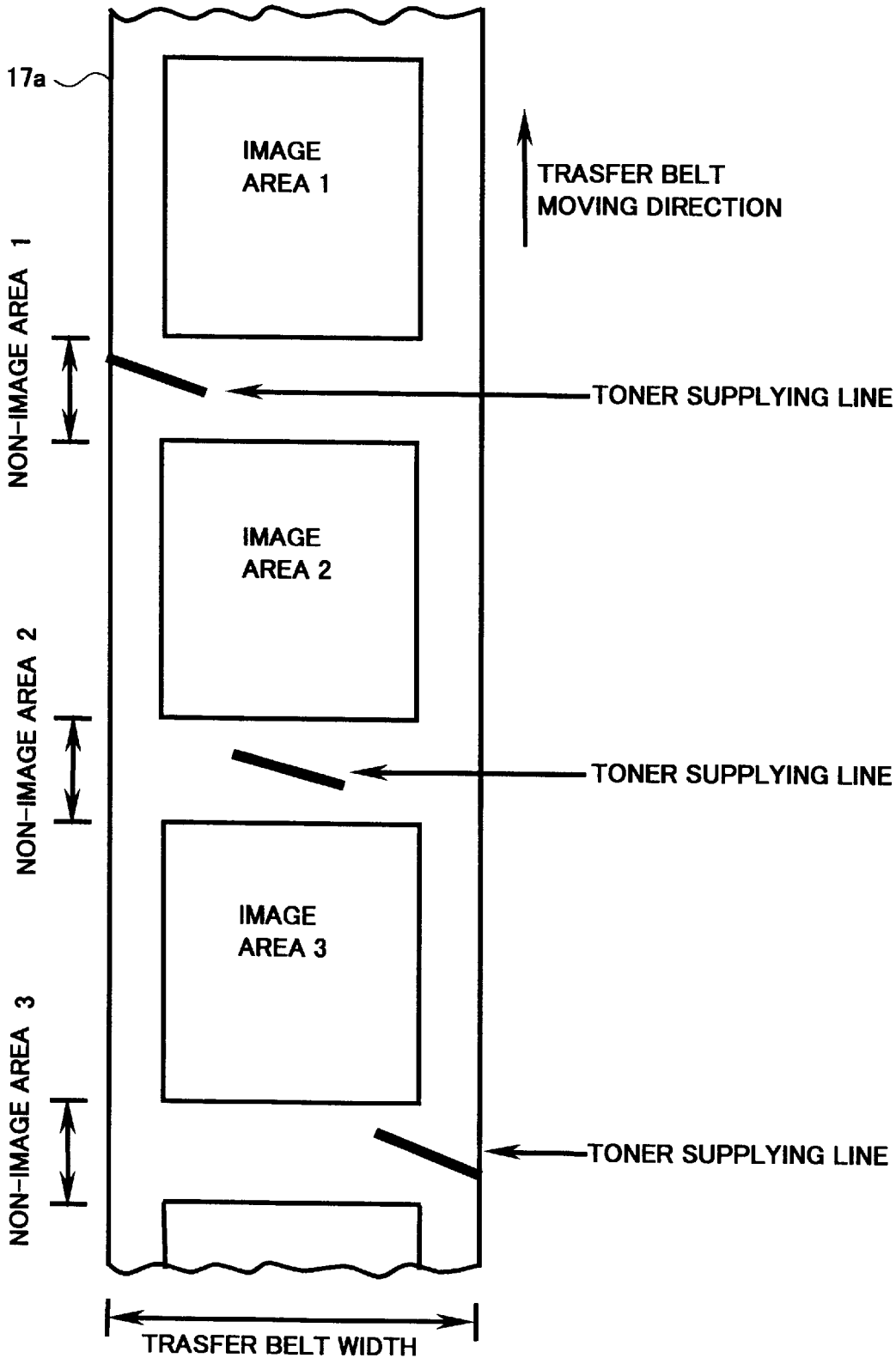
FIG. 9 is another illustration explaining how different exemplary lines for supplying toner are formed in non-image areas of a photoconductive element.

Next, FIG. 9 illustrates still another example of the toner-line, which is divided and written onto each non-image area between successive image areas on the transfer belt 17*a* when developed on a plane surface. The toner-line is divided and written in an inclined manner at the non-image areas between successive image areas on the transfer belt 17*a*. Thereby, a full width length of the toner-line is not input on the cleaning blade 17*e* at the same time, and the cleaning performance of the cleaning blade 17*e* is significantly improved.

A contact pressure of the cleaning blade can be decreased, and the toner on the transfer belt 17*a* can be removed even when a relatively low contact pressure used during the usual cleaning operation is applied. The deterioration of the cleaning blade 17*e* at the early stage can also be avoided. Further, dividing and writing the inclined toner-line onto each non-image area between successive image areas can decrease the amount of input toner per one non-image area between successive image areas.

Further, in a case of writing an inclined straight line at the non-image area between successive image areas, a long space is required. However, in a case of dividing and writing the inclined straight line onto each non-image area between successive image areas, the long space is not required even though the inclined line is used.

Figure 10:
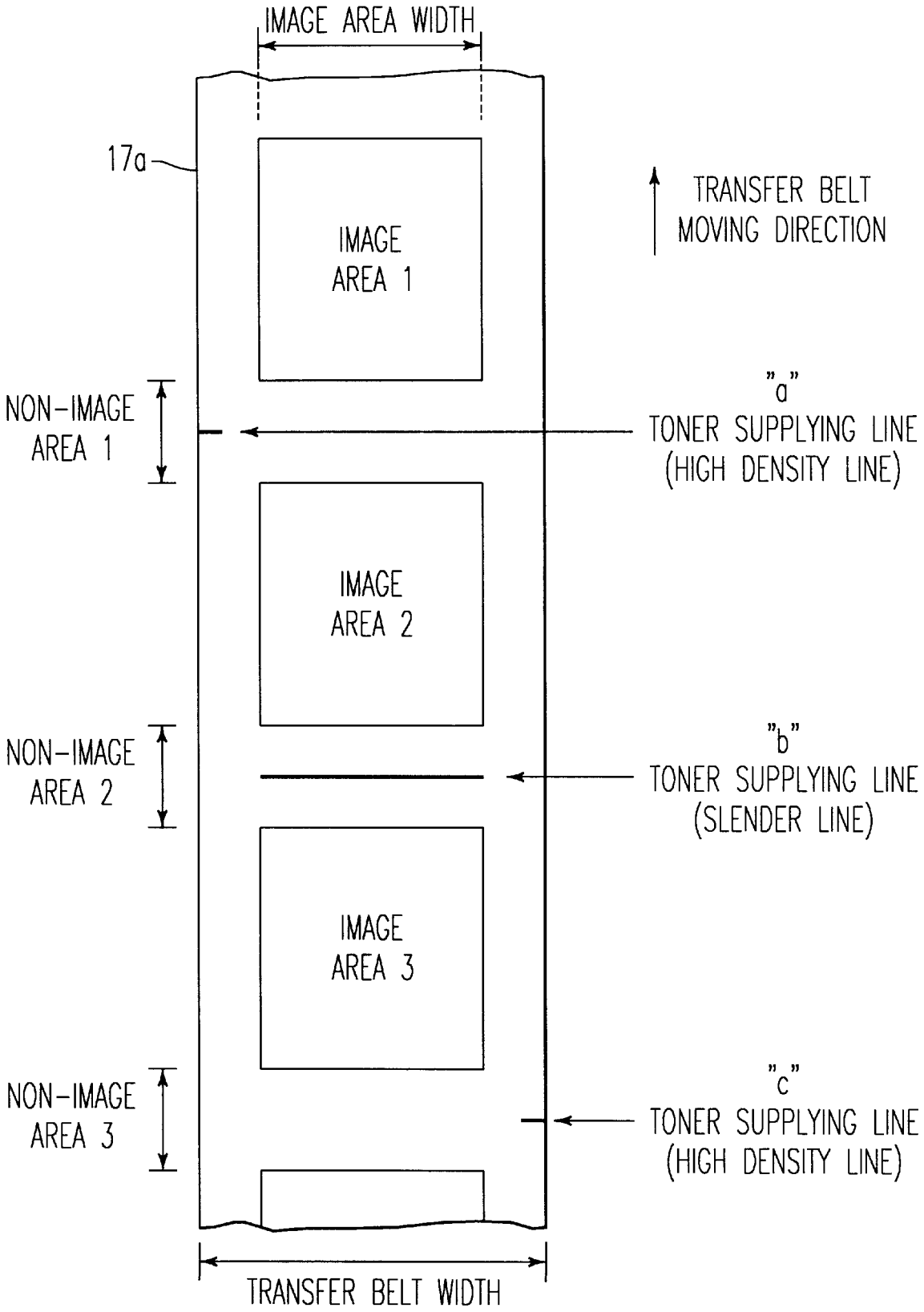
FIG. 10 is yet another illustration for explaining how different exemplary lines for supplying toner are formed in non-image areas of a photoconductive element.

Next, FIG. 10 illustrates another example of the toner-line, which is divided and written onto each non-image area between successive image areas on the transfer belt 17*a* when developed on a plane surface. FIG. 10 shows the straight toner-line perpendicularly to the moving direction of the transfer belt 17*a*. The toner-line is divided into three lines and written at each non-image area between successive image areas in a density different each other.

In this example, lines a and c at side portions of the transfer belt 17*a* and outside of the image area have a density higher than that of the line b located at a position within the width of the image area in the center part of the transfer belt 17*a*. The line b has a low density such as, for example, the density of a background fouling. As shown in FIG. 10, the toner-line is divided and written onto each non-image area between successive image areas. Thereby, the full width toner-line is not input to the cleaning blade 17*e* at the same time, and the cleaning performance of the cleaning blade 17*e* is significantly improved.

A contact pressure of the cleaning blade can be decreased, and the toner on the transfer belt 17*a* can be removed even though a relatively low contact pressure used during the usual cleaning operation is applied. A deterioration of the cleaning blade 17*e* at the early stage can also be avoided. Further, the amount of toner supplied per each non-image area between successive image areas is decreased and an amount of the toner supplied in each non-image area between successive image areas can be controlled (i.e., by dividing the toner-line into each non-image area between successive image areas and by writing the toner-lines with a different density).

Further, the number of divided toner-line segments is not limited to three as shown in the figures. The toner-line may be divided into more segments than described above if required. Further, combinations of the toner-lines, such as the inclined toner-line as shown in FIG. 8, and a variation of the thickness and density of the divided lines may be selected.

In addition, the toner-line divided onto each non-image area between successive image areas relevant to the present invention is usually formed based on a number of sheets on which an image is formed. The greater the frequency of forming the toner-lines, the harder it is for the cleaning blade 17*e* to be peeled off. Hoever, needless toner is consumed and malfunction of the cleaning operation is caused when the toner-lines are formed too frequently. If a lot of toner corresponding to background fouling is on the transfer belt 17*a* and is input to the tip portion of the cleaning blade 17*e*, it may not be necessary to form a plurality of toner-line segments.

However, background fouling occurs depending on the humidity and when the humidity is approximately 90%, background fouling hardly occurs. Accordingly, the divided toner-line segments should be input in a relatively short cycle under an environment of high humidity to prevent the cleaning blade 17*e* from peeling off. When the frequency of forming the toner-line segments is set according to the operating condition of the image forming apparatus, such as the humidity, a temperature, and existence or absence of an air conditioner, it is possible to reduce the amount of toner used. In addition, the cleaning blade does not peel off and become damaged.

Next, a forming device of the aforementioned toner-line is described.

In the image forming apparatus such as the digital copying machine, as illustrated in FIG. 1, or a printer, a facsimile machine, etc., having optical writing devices 7 and 14 for forming a latent image from the image data using the laser light or the LED, if a pattern of the divided toner-lines which is shown in FIGS. 7 and 10 is previously stored in a memory area for the image data, the pattern of the divided toner-lines can be used for forming the toner-lines as the image data.

Figure 11:
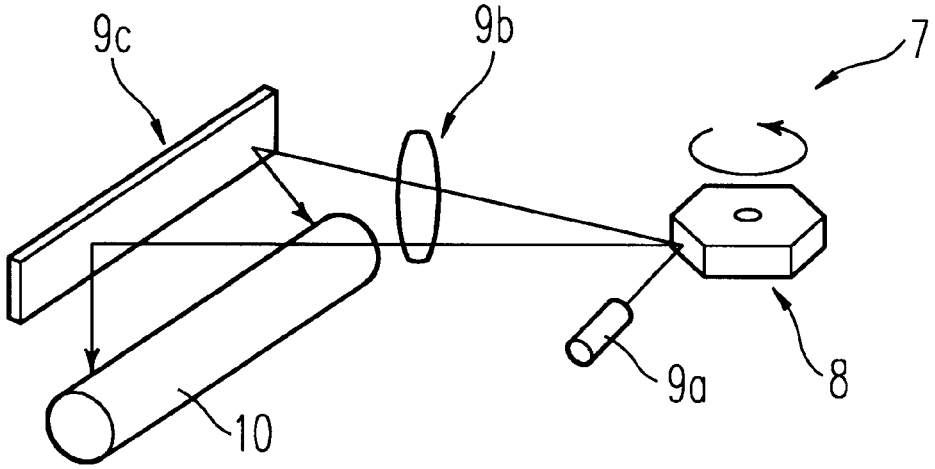
FIG. 11 is an illustration representing an example of a toner-line forming device which is used in an image forming apparatus having a laser writing device.
Figure 12:
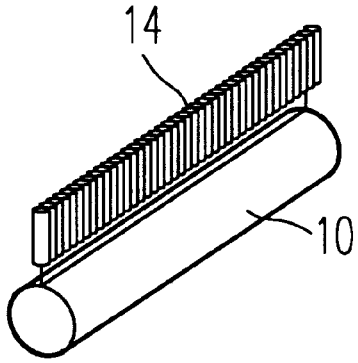
FIG. 12 is an illustration of another example of a toner-line forming device which is used in an image forming apparatus having an LED writing device.

Thereby, a latent image of the toner-lines that are divided and positioned at each non-image area between successive image areas on the photoconductive element 10 can be formed by the optical writing devices 7 and 14 with ease. An example of the toner-line forming device used by the image forming apparatus having the optical writing device using laser light is illustrated in FIG. 11. Another example of the toner-line forming device used by the image forming apparatus having the optical writing device using the LED array is shown in FIG. 12. Further, a block diagram of a control system is shown in FIG. 13.

Figure 13:
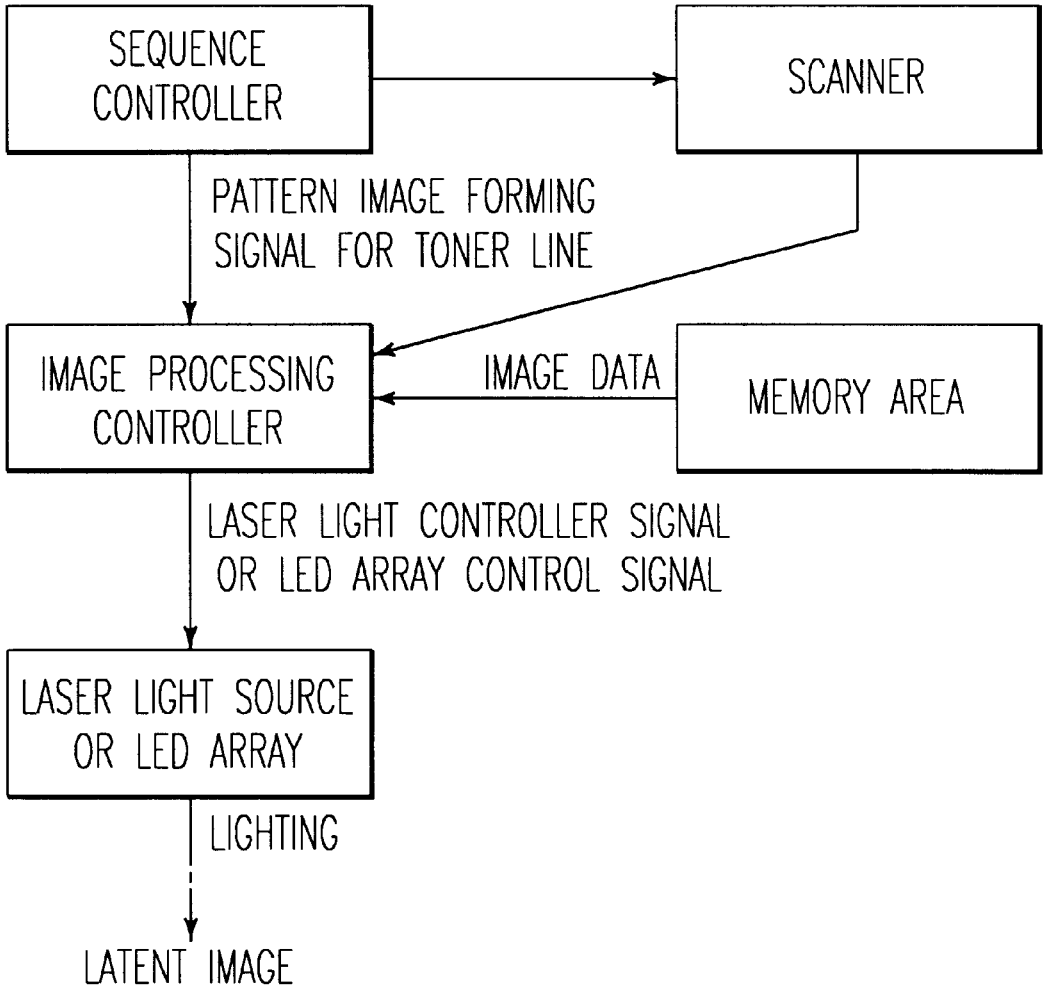
FIG. 13 is a block diagram of control systems included in the image forming apparatuses of FIGS. 10 and 11.

The optical writing device 7 shown in FIG. 11 deflects the laser light from the laser diode 9*a*, which emits light on the basis of a control signal transmitted from an image processing controller shown in FIG. 13, by a polygon mirror 8. Further, the optical writing device 7 scans the photoconductive element 10 through a scan-focusing lens 9*b*, and forms a latent image on the photoconductive element 10 by sequentially scanning the laser light.

The optical writing device 7 forms the latent image with the laser light at a time when required, at a position out of an image area (the non-image area between successive image areas) on the photoconductive element 10 according to the image data of the toner-line pattern which is previously stored in the memory area. In addition, if the latent image is developed with toner in the developing device (not shown) and the toner image is directly transferred onto the transfer belt (not shown), the toner-line divided into a plurality of lines positioned at each non-image area between successive image areas, as shown in FIGS. 7 through 10, is formed.

An optical writing device 14 in FIG. 12 has a function of exposing the photoconductive element 10 with light from the LED array through the lens array, which emits light by the control signal transmitted from the image processing controller shown in FIG. 13. The optical writing device 14 forms the latent image at a position out of the image area (non-image area between successive image areas) on the photoconductive element 10 by the LED array according to the image data of the toner-line pattern stored in the memory area, at a time when required.

If the latent image is developed by the toner in the developing device (not shown), and directly transferred onto the transfer belt, the divided toner-lines for each non-image area between successive image areas, as shown in FIGS. 7 through 10, is formed.

The above-mentioned example is that of the toner-line forming device in the digital image forming apparatus shown in FIG. 1. Next, another example of a toner-line forming device in the image forming apparatus which includes an exposing device that directly exposes an original image to the photoconductive element 10 is described.

Figure 15:
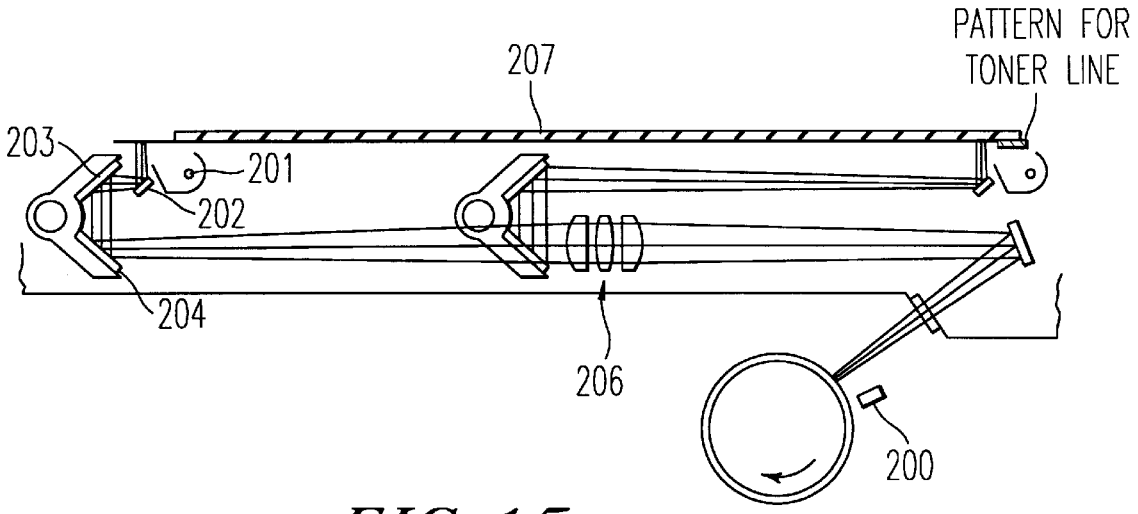
FIG. 15 is an illustration of yet another example of a toner-line forming device, which is used in an image forming apparatus having an exposing device.
Figure 16:
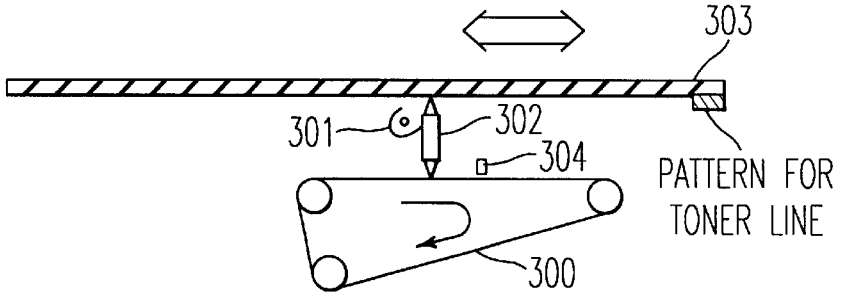
FIG. 16 is an illustration of still another example of a toner-line forming device, which is used in an image forming apparatus having an exposing device.

In the image forming apparatus which directly exposes the original image to the photoconductive element 10 by the exposing device, a pattern for forming the toner-line is provided by use of a means, such as printing, at a non-image area on the contact glass where the original document is mounted. An example of the toner-line forming means in the image forming apparatus having the exposing device is shown in FIGS. 14 through 16.

Figure 14:
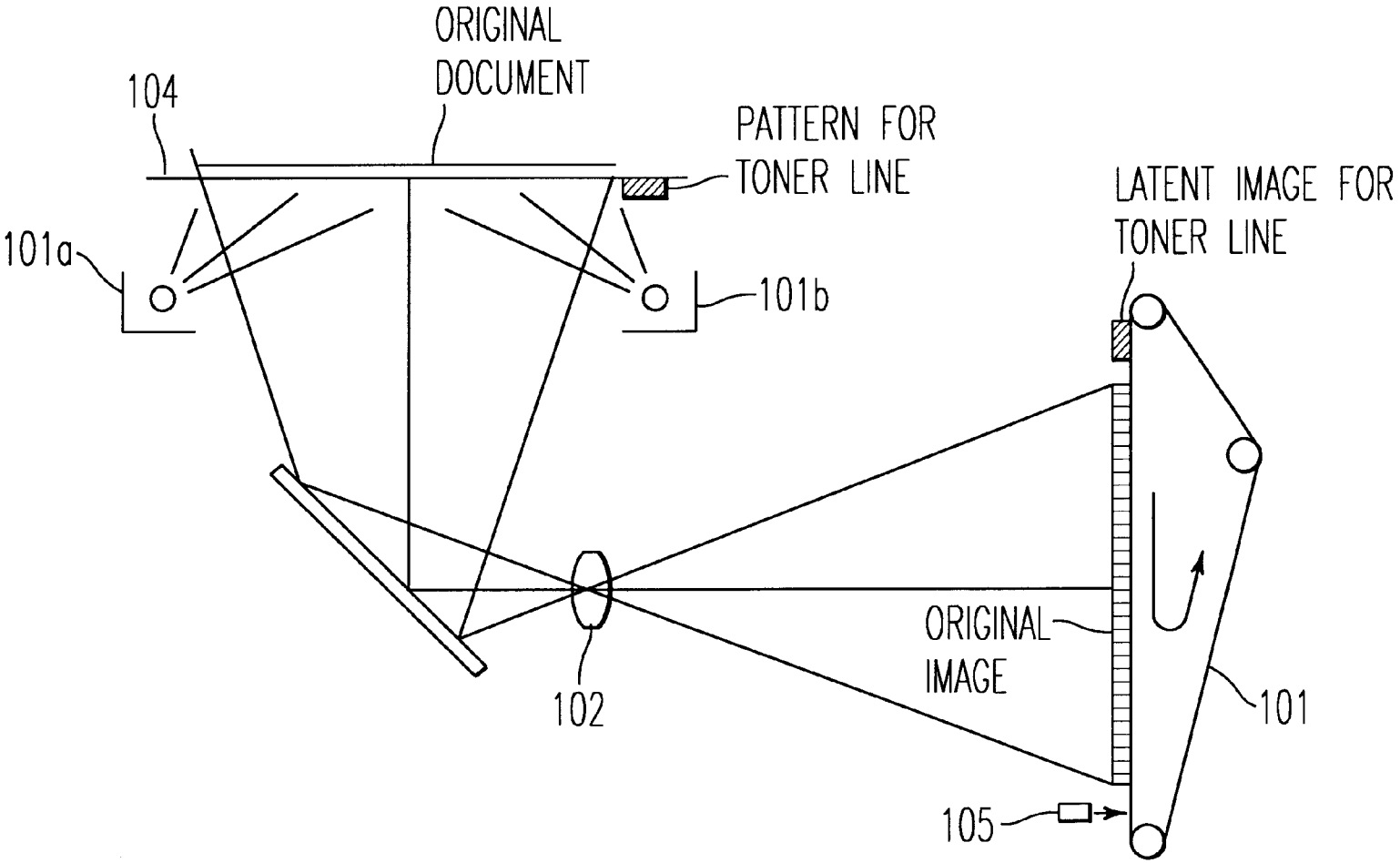
FIG. 14 is an illustration of still another example of a toner-line forming device, which is used in an image forming apparatus having an exposing device.

The image forming apparatus in FIG. 14 has a function of forming a latent image on a belt-shaped photoconductive element 101 by light irradiated by exposure lamps 101*a* and 101*b* of the exposing device according to the signal transmitted from a sequence controller of a control section (not shown), and by the light which is focused by the lens 102.

The toner-line pattern shown in FIGS. 7 through 10 is formed as the latent image at the position of the non-image area between successive image areas before the leading edge portion of the image area or after the trailing edge portion of the image area on the photoconductive element 101, which is an exposure surface of the contact glass 104 other than the image area. Thereby, the toner-line pattern is formed as the latent image at each non-image area between successive image areas before the leading edge portion or after the trailing edge portion of the image area on the photoconductive element 101. Further, if the latent image is developed by the toner in the developing device (not shown) and transferred onto the transfer belt (not shown), the toner-line is formed on the transfer belt.

Even though the toner-line pattern is formed as a latent image in a same number as that of the lighting operation of the exposing device, the latent image toner-line pattern can be erased at a time other than necessity by use of an eraser 105 at a next process. In addition, there is also another means for forming the toner-line pattern as a latent image at a time when required, by enlargement and reduction of the exposing area. Further, since the latent image other than the necessary part of the toner-line pattern can be erased by the eraser 105 using the LED array or the like, the divided toner-lines pattern as shown in FIGS. 7 through 10 can easily be formed.

The image forming apparatus shown in FIG. 15 has a function of forming the latent image on the drum-like shaped photoconductive element 200 by the following process:

lighting the exposure lamp 201 of the exposing device by the signal transmitted from the sequence controller of the control section (not shown);

scanning of the exposure lamp 201, a first mirror 202, a second mirror 203, and a third mirror 204; and focusing the light by the lens 206.

Thereby, the toner-line pattern is formed as a latent image at a position before the leading edge of the image area or after the trailing edge of the image area on the photoconductive element in the non-image area between successive image areas which is an exposure surface of the contact glass 207 other than the image area by forming the toner-line pattern as shown in FIGS. 7 through 10. Thereafter, if the latent image is developed by the toner in the developing device (not shown) and transferred onto the transfer belt (not shown), the toner-line is formed on the transfer belt.

Even though the toner-line pattern is formed as a latent image in a same number as that of irradiation of the exposing device, the latent image toner-line pattern can be erased at a time other than necessity by use of an eraser as a device at the next process. In addition, there is also still another means for forming the toner-line pattern as a latent image at a time when required, by lengthening and shortening of the scanning area, or still another means for forming the latent image by exposing the pattern when required, changing lighting timing of the exposure lamp 2*b*.

Further, since the latent image other than the necessary part of the toner-line pattern can be erased by using the LED array or the like as the eraser, the divided toner-lines pattern as shown in FIGS. 7 through 10 can easily be formed.

The image forming apparatus shown in FIG. 16 has a function of forming the latent image on the belt-shaped photoconductive element 300 by the light, which is focused by use of the lens 302, on the basis of the following process:

lighting the exposure lamp 301 of the exposing device by the signal transmitted from the sequence controller of the control section (not shown); and moving the contact glass 303.

Thereby, the toner-line pattern is formed at a position before the leading edge of the image area or after the trailing edge of the same as a latent image on the photoconductive element 300 in the non-image area between successive image areas at the contact glass 303 other than the image area by forming the toner-line pattern as shown in FIGS. 7 through 10.

Thereafter, if the latent image is developed by the toner in the developing device (not shown) and transferred onto the transfer belt (not shown), the toner-line is formed on the transfer belt.

Even though the toner-line pattern is formed as a latent image in a same number as the number of irradiation of the exposing device, the latent image toner-line pattern can be erased at a time other than necessity by use of an eraser 304 as a device at next process. In addition, there is also still another means for forming the toner-line pattern as a latent image at a time when required, by lengthening and shortening of the scanning area or still another means for forming the latent image by exposing the pattern when required, changing lighting timing of the exposure lamp 301.

Further, since the latent image other than the necessary part of the toner-line pattern can be erased by the eraser 304 using the LED array or the like as the eraser, the divided toner-lines pattern as shown in FIGS. 7 through 10 can easily be formed.

The controller of this invention may be conveniently implemented using a conventional general purpose digital computer of microprocessor programmed according to the teachings of the present specification, as is apparent to those skilled in the computer technology. Appropriate software coding can readily be prepared by skilled programmers based on the teachings of the present disclosure, as will be apparent to those skilled in the software art. The invention may also be implemented by the preparation of application specific integrated circuits or by interconnecting an appropriate network of conventional component circuits, as will be readily apparent to those skilled in the art.

Obviously, numerous modifications and variations of the present invention are possible in light of the above teachings. It is therefore to be understood that within the scope of the appended claims, the invention may be practiced otherwise than as specifically described herein.

This application is based on Japanese patent application No. JPAP09-279002 filed on Oct. 13, 1997, the entire contents of which are hereby incorporated by reference.

I claim:

1. An image forming apparatus comprising:

a seamless belt-shaped moving member positioned adjacent to an image bearing member;

a bias voltage applying roller positioned at a rear face side of said seamless belt-shaped moving member;

a cleaning blade configured to clean a surface of said seamless belt-shaped moving member;

a transfer-convey device configured to transfer a toner image on said image bearing member onto a transfer member; and a toner-line forming device configured to form a toner-line which is divided into a plurality of toner-line segments when developed, each of said plurality of toner-line segments written to an individual non-image area between successive image areas on said image bearing member and transferred onto said seamless belt-shaped moving member, wherein at least one of said plurality of toner-line segments has a characteristic different from a characteristic of other toner-line segments.

2. The image forming apparatus according to claim 1, wherein said transfer-convey device moves said seamless belt-shaped moving member holding said transfer member into contact with said image bearing member, and applies a voltage to said bias voltage applying roller, thereby transferring said toner image on said image bearing member onto said transfer member, and said transfer-convey device conveys said transfer member which bears said toner image on a surface thereof to a fixing device, and said cleaning blade cleans toner remaining on a surface of said seamless belt-shaped moving member.

3. The image forming apparatus according to claim 1, wherein said each of said plurality of toner-line segments has a different characteristic.

4. The image forming apparatus according to claim 1, wherein said plurality of toner-line segments include inclined toner-line segments.

5. The image forming apparatus according to claim 1, wherein said plurality of toner-line segments include at least one inclined toner-line segment.

6. The image forming apparatus according to claim 1, wherein said each of said plurality of toner-line segments has a different density.

7. The image forming apparatus according to claim 1, wherein at least one of said plurality of toner-line segments has a density different from a density of other toner-line segments.

8. The image forming apparatus according to claim 1, wherein said plurality of toner-line segments include at least three toner-line segments.

9. The image forming apparatus according to claim 1, wherein said each of said plurality of toner-line segments has a different width.

10. The image forming apparatus according to claim 1, wherein at least one of said plurality of toner-line segments has a width different from a width of other toner-line segments.

11. An image forming apparatus comprising:

a seamless belt-shaped moving means positioned adjacent to an image bearing means;

means for applying a bias voltage, said means for applying being positioned at a rear face side of said seamless belt-shaped moving means;

means for cleaning a surface of said seamless belt-shaped moving means;

means for transferring a toner image on said image bearing means onto a transfer means;

means for forming a toner-line which is divided into a plurality of toner-line segments when developed, each of said plurality of toner-line segments written to an individual non-image area between successive image areas on said image bearing means and transferred onto said seamless belt-shaped moving means, wherein at least one of said plurality of toner-line segments has a characteristic different from a characteristic of other toner-line segments.

12. The image forming apparatus according to claim 11, wherein said means for transferring moves said seamless belt-shaped moving means holding said transfer means into contact with said image bearing means, and applies a voltage to said bias voltage applying means, thereby transferring said toner image on said image bearing means onto said transfer means, and said means for transferring conveys said transfer means which bears said toner image on a surface thereof to a fixing means, and said cleaning means cleans toner remaining on a surface of said seamless belt-shaped moving means.

13. The image forming apparatus according to claim 11, wherein said plurality of toner-line segments include at least one inclined toner-line segment.

14. The image forming apparatus according to claim 11, wherein at least one of said plurality of toner-line segments has a density different from a density of other toner-line segments.

15. The image forming apparatus according to claim 11, wherein said plurality of toner-line segments include at least three toner-line segments.

16. The image forming apparatus according to claim 11, wherein said each of said plurality of toner-line segments has a different width.

17. The image forming apparatus according to claim 11, wherein at least one of said plurality of toner-line segments has a width different from a width of other toner-line segments.

18. A method for decreasing frictional wear of a cleaning blade, comprising the steps of:

forming a toner-line into a plurality of toner-line segments, each of said toner-line segments written to an individual non-image area between successive image areas on an image bearing member;

transferring each of said plurality of toner-line segments onto a transfer belt; and cleaning said transfer belt with a cleaning blade, wherein said step of forming forms at least one of said plurality of toner-line segments to include a characteristic different from a characteristic of other toner-line segments.

19. The method according to claim 18, wherein said step of forming forms said plurality of toner-line segments to include at least one inclined toner-line segment.

20. The method according to claim 18, wherein said step of forming forms at least one of said plurality of toner-line segments to include a density different from a density of other toner-line segments.

21. The method according to claim 18, wherein said step of forming forms said plurality of toner-line segments to include at least three toner-line segments.

22. The method according to claim 18, wherein said step of forming forms at least one of said plurality of toner-line segments to include a different width from a width of other toner-line segments.

* * * * *